United States Patent [19]

Koppers et al.

[11] 4,277,204

[45] Jul. 7, 1981

[54] EXCAVATION ROOF SUPPORT AND METHOD OF INSTALLING THE SAME

[75] Inventors: Manfred Koppers, Duisburg; Karlheinz Bohnes, Bochum, both of Fed. Rep. of Germany; Harry J. Fitzgerald, Pittsburgh, Pa.

[73] Assignee: Bochumer Eisenhütte Heintzmann GmbH & Co., Bochum, Fed. Rep. of Germany

[21] Appl. No.: 74,998

[22] Filed: Sep. 13, 1979

[51] Int. Cl.[3] ..... E21D 15/00

[52] U.S. Cl. ..... 405/288; 248/354 R

[58] Field of Search ..... 405/229, 230, 266, 267, 405/288, 289, 290; 248/354 R, 356

[56] References Cited

U.S. PATENT DOCUMENTS

| | | | |
|---|---|---|---|
| 1,752,101 | 3/1930 | Meutsch | 248/356 |
| 3,345,824 | 10/1967 | Turzillo | 405/266 X |
| 4,102,138 | 7/1978 | Dreker et al. | 405/289 X |
| 4,167,361 | 9/1979 | Petro et al. | 405/290 |
| 4,185,940 | 1/1980 | Spies | 405/288 |

FOREIGN PATENT DOCUMENTS

| | | | |
|---|---|---|---|
| 479871 | 11/1975 | U.S.S.R. | 405/289 |
| 607034 | 5/1978 | U.S.S.R. | 405/289 |

*Primary Examiner*—David H. Corbin
*Attorney, Agent, or Firm*—Michael J. Striker

[57] ABSTRACT

A method and a system are disclosed for supporting an overburden. A single-section or telescoped multi-section longitudinally slit prop casing of light sheet material such as cardboard or metal has a fabric bag installed in it. When the casing is erected the bag is filled with a slurry of hardenable substance which, upon hardening, forms in the bag a column which supports the overburden. The casing may be left in place or it may be removed for re-use.

16 Claims, 18 Drawing Figures

FIG. 2A
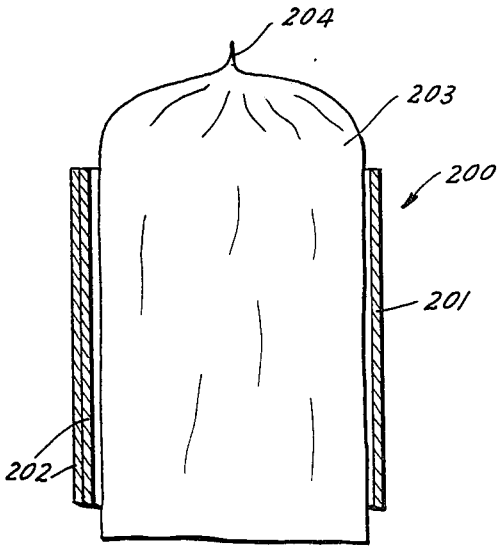
FIG. 3A
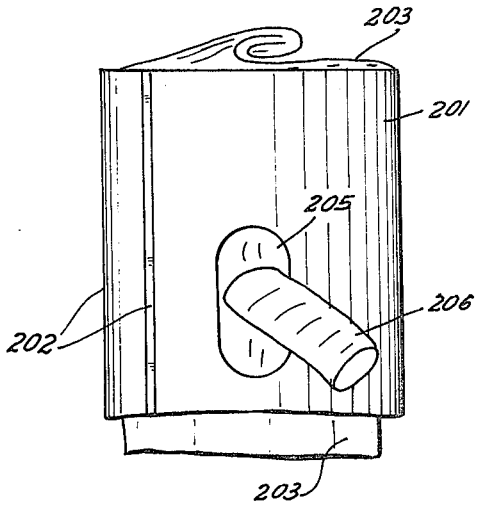
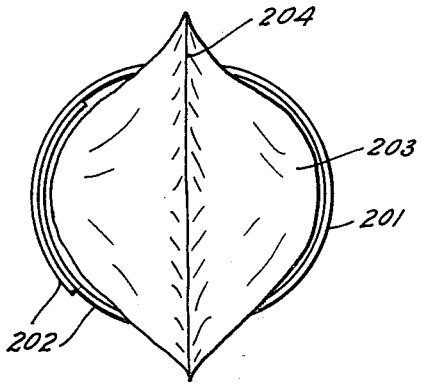
FIG. 2B
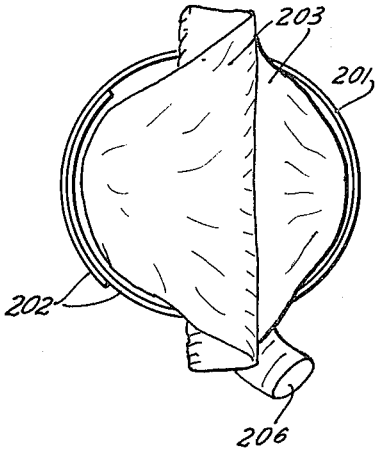
FIG. 3B

FIG. 4A
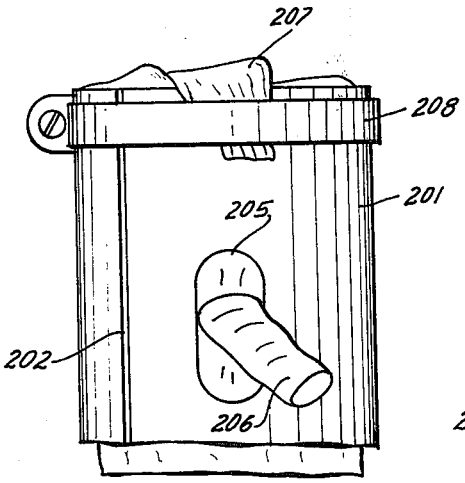
FIG. 4B
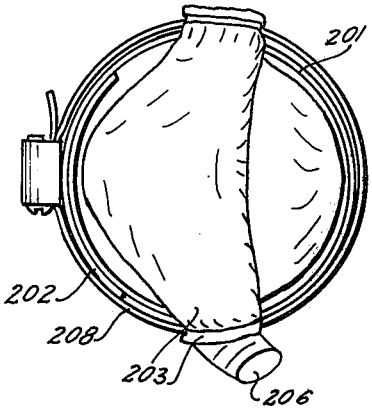
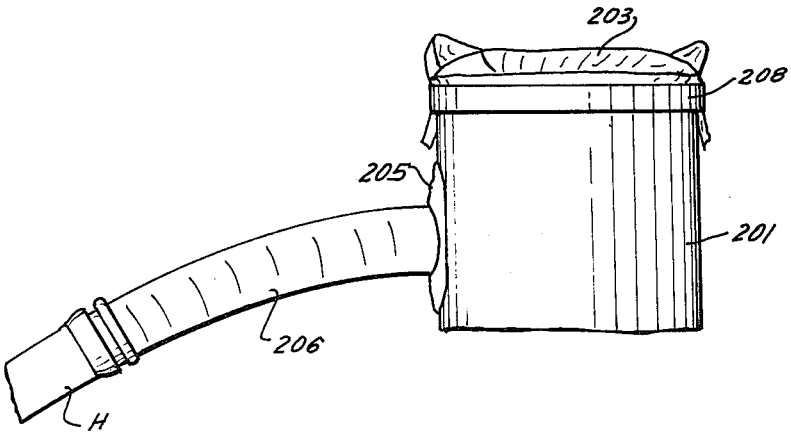
FIG. 5

EXCAVATION ROOF SUPPORT AND METHOD OF INSTALLING THE SAME

BACKGROUND OF THE INVENTION

1. Field of the Invention

This invention is directed to a method of supporting a roof, particularly a roof of an underground excavation such as a mine or tunnel, and to a system for carrying out the method, i.e., to apparatus for this purpose.

2. The Prior Art

In such underground excavations as mining galleries, tunnels and the like, the roof of the excavation must be supported against cave-in under the pressure of the overburden. Various approaches for effecting such support are known from the prior art. For example, in coal mining it is known to use the so-called "room and pillar system" in which roof bolting is used, i.e., steel rods or bars which penetrate the rock layers and hold them together to prevent collapse. It is also known to provide various kinds of supporting structures of wood and/or steel in which rigid or slightly yieldable supporting elements, for example pit props, are used to support the roof from below against collapse.

The problem with this latter type of approach, to which the present invention is also directed, is that the prior-art proposals are all relatively complicated and expensive and that the supports are difficult to erect and to move. The elements involved are relatively expensive and of considerable weight so that they are difficult to handle. There is also a pronounced lack of economy, both with respect to the materials involved and in the installation work required. As world petroleum resources begin to dwindle, increased emphasis is being placed on mining of coal; also, with the continuing decrease of such in-ground resources as minerals and the like there is a renewed interest in mining of deposits which in the past were abandoned because they were of poor quality and/or because they were too difficult to extract. In all these operations the question of cost effectiveness is, of course, of considerable importance in the determination whether they are economically feasible—and one of the factors which has a very substantial influence on these economic calculations is the cost of the roof supports which are required in large quantities. Further improvements in this field are, therefore, urgently needed.

SUMMARY OF THE INVENTION

A general object of the present invention is to overcome the disadvantages of the prior art.

A more particular object is to provide an improved method of supporting an overburden, particularly a roof of an underground excavation such as a mine, which is not possessed of the prior-art disadvantages.

Another object of the invention is to provide such an improved method which allows the handling and installation of the support elements in a simpler and quicker manner than heretofore possible.

A concomitant object is to provide a method which facilitates the erection of roof supports and reduces the costs involved therein.

A further object of the invention is to provide an improved system (e.g., arrangement) for supporting a roof, particularly a roof of an underground excavation such as a mine.

The improved system is to be simpler and less expensive to construct than those of the prior art, but to be highly reliable in operation.

An additional object of the invention is to provide such an improved system which utilizes support elements that can be readily moved and installed because they are light in weight.

A concomitant object of the invention is to provide such a system wherein the support elements are inexpensive.

Still another object is to provide a system using prop casing which can be recovered and re-used.

Yet a further object is to provide such a system in which the diameter of the prop casings (and hence the final load-bearing capacity of the ultimately obtained column) can be varied in an extremely simple and efficient manner.

Pursuant to the above objects, and still others which will become apparent from a reading of the specifaciation, one feature of the invention resides in a method of supporting an overburden, particularly a roof of an underground excavation such as a mine. Briefly stated, such a method may comprise the steps of providing a hollow tubular prop casing having at least one section of self-supporting sheet material and which is circumferentially incomplete and has a longitudinally extending slit, over-lapping marginal portions of the sheet material which bounds the slit, to such an extent as to obtain a desired diameter of the section, arresting the overlapped portions in their overlapped condition, erecting the prop casing, installing in the prop casing a fabric bag extending lengthwise of that casing, and filling the fabric bag with a hardenable substance in flowable condition so that that under the influence of the substance and shaped by the casing, the bag and its contents form a column which, upon hardening of the substance, is by itself able to support the roof.

The system or arrangement according to the invention may, briefly stated, comprise a hollow tubular prop casing having at least one section of self-supporting sheet material and which is circumferentially incomplete and has a longitudinally extending slit bounded by marginal portions which can be overlapped to a desired degree to give the section a selectable diameter, means for arresting the marginal portions in a desired overlapped position, fabric bag means insertable into this section, and means for filling the fabric bag means with a hardenable substance in flowable condition so that the fabric bag means accommodates itself to the casing and the substance, upon hardening thereof, forms in the fabric bag means a solid column which is by itself able to support the roof.

It is important to understand that the inventive prop casing has no supporting function per se at all, acting only as a receptacle for the hardenable substance. The supporting function is carried out by the hardenable substance when the same has hardened and forms a solid column within the prop casing. For this reason the prop casing can be made of relatively lightweight and inexpensive material, for instance sheet metal, synthetic plastic material such as polyvinylchloride or polyethylene, or even of a heavy grade of cardboard the inner surface of which is coated (e.g., with wax or with a foil of such synthetic plastic material as polyvinylchloride or polyethylene) to prevent the cardboard from disintegrating under the influence of the filler substance while the same is still in flowable condition. The fabric bag means, on the other hand, may simply be a jute bag or a similar bag of woven fibrous material which will allow liquid to escape but will retain the (much more viscous) flowable substance.

The filler substance itself may be a concrete slurry, i.e., a mixture of water and a quick-binding cement, preferably in form of cement powder. Aggregate may be added (it might already be accommodated in the fabric bag before the slurry is admitted into the same) to further increase the strength of the column being formed. In lieu of, or in addition to the aggregate the fabric bag may, after it is installed at the place where a support is to be erected, already contain at least some of the cement power which is ultimately required to make the slurry. Other materials are also suitable for the hardenable substance, for example gypsum which again may be reinforced with aggregate, or a two-component adhesive system of synthetic plastic material which, when the two components are admixed with one another, will harden and form the requisite solid column. Here, again, aggregate may be employed in addition, to become embedded in the two-component system so as to further reinforce the same. The aggregate can be in the form of gravel or the like as is known from the construction industry. If gypsum is used, some or all of the gypsum powder required to form the solid column may already be contained in the fabric bag before water is admitted into the same, and if a two-component adhesive system is used one of the two components may already be wholly or in part accommodated in the fabric bag before the other component is admitted into the same. The aggregate may be admitted from outside during admission of the other component, or of the water, but preferably will already be present in the interior of the fabric bag at this time. The fabric structure of the bag must, of course, be such that water or other liquid cannot escape at the same rate as it is admitted into the bag, but only at a slower rate which permits any component already contained in the bag at the time liquid is admitted, to become mixed with the liquid. Of course, if a premixed slurry is introduced so that no component of the hardenable substance need be preliminarily added to the bag, then this problem does not exist.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIGS. 2A and B are a fragmentary vertical section and a top plan view, respectively, showing the filled bag in the prop casing;

FIGS. 3A and B are a fragmentary side view and a top plan view, respectively, of FIGS. 2A and 2B, but prior to filling of the bag;

FIGS. 4A and B are views similar to FIGS. 3A and 3B, but of a somewhat different embodiment;

FIG. 5 is a fragmentary side view, showing the bag-filling operation;

DESCRIPTION OF THE PREFERRED EMBODIMENTS

Figure 1:
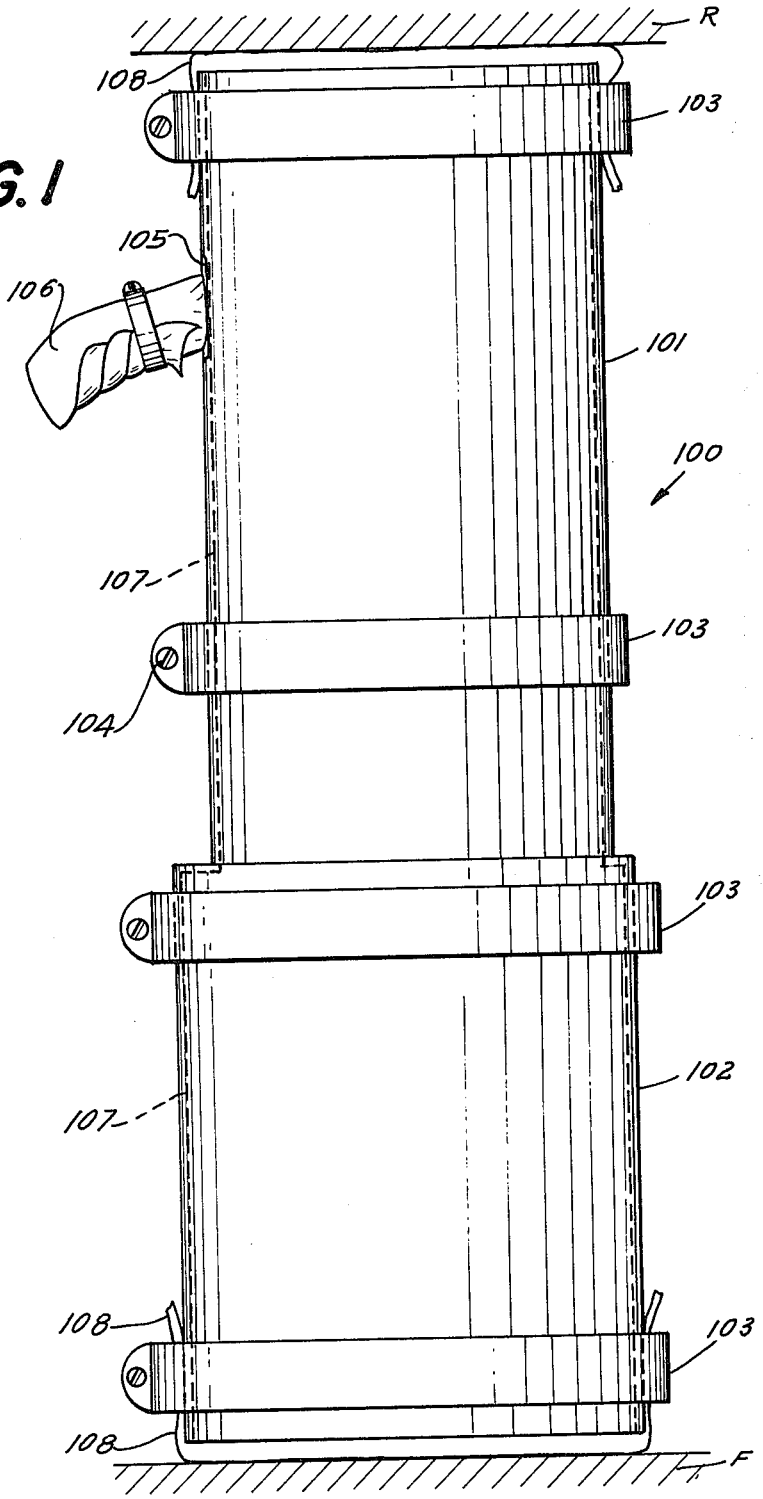
FIG. 1 is a somewhat diagrammatic side view, showing one embodiment of the invention.

Referring now to the drawing in detail, and first to FIG. 1 thereof, it will be seen that in this embodiment, designated in toto with reference numeral 100, an upper prop casing section 101 is telescoped into a lower prop casing section 102. Since these light-weight sheet-material sections are longitudinally slit, their diameter can be selected at will by increasing the overlap of their free edges to the desired extent. The sections are held at the selected degree of overlap by clamps 103, e.g., circumferentially incomplete metal annuli which are placed about them and which have their free ends connected and drawn together by screws 104. These clamps 103 also reinforce the sections 101, 102 against internal pressure. A fabric bag 107 (of e.g., jute or the like) is inserted into the sections 101, 102 and its upper and lower ends 108 are folded outwardly onto the outer surface of the respective section, there to be held by one of the clamps 103. One of the sections, here the section 101, has a hole 105 through which a filling spout 106 of the bag 107 extends outwardly. The spout 106 may be a fabric, plastic or other tube or hose which is seamed or otherwise secured to the bag 107.

FIGS. 2A and 2B show an embodiment 200 in which the upper end (and the not illustrated lower end) of the bag 203 in the casing 201 are not folded over, but are closed by a seam 204. The overlap of the casing 201 is shown at 202. Of course, in actual use the upper (and lower) ends of the bag will not, upon being filled, come to a crest as shown in these Figures, because they will flatten themselves against the roof and floor, respectively.

FIGS. 3A and 3B show the embodiment of FIGS. 2A and 2B prior to filling. The cut-out or hole 205 in casing 201 is visible, as is the filling spout 206. The upper end portion of bag 203 is rolled up at this stage of the operation.

The embodiment of FIGS. 4A and 4B differs from the one in FIGS. 2 and 3 in that the upper end portion 207 of the bag is folded under a clamp 208 which is similar to clamps 103 in FIG. 1.

Figure 6:
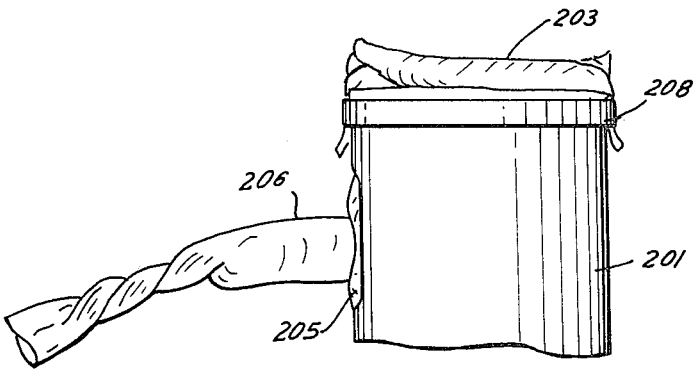
FIG. 6 is a view similar to FIG. 5 but showing the bag-filling inlet being closed off against the escape of hardenable substance.
Figure 7:
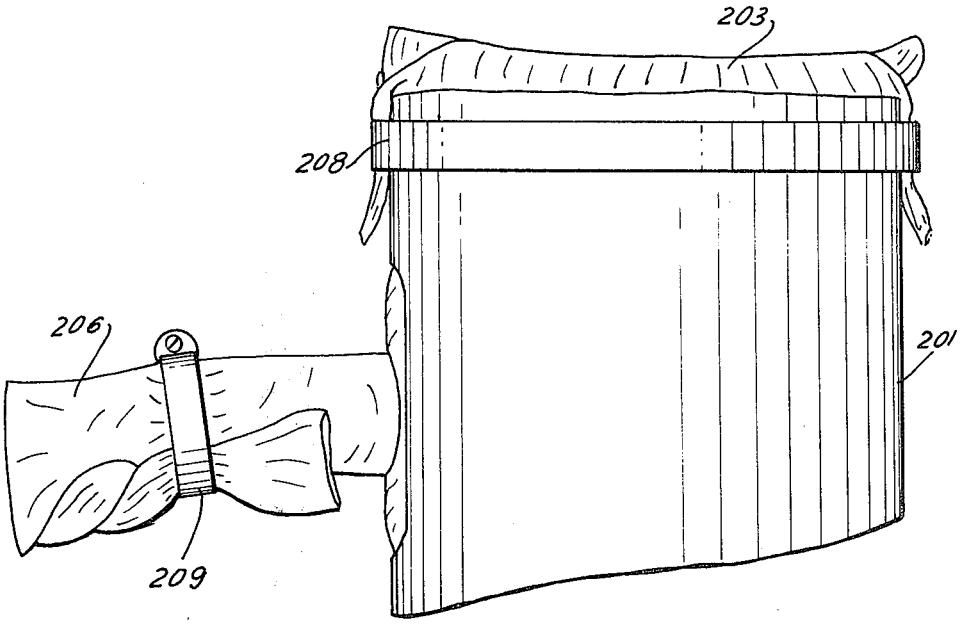
FIG. 7 is a view similar to FIG. 6, on an enlarged scale, showing the bag-filling inlet secured.

FIG. 5 (which is applicable to all embodiments) shows a filling hose H connected to the spout 206; it receives the hardenable substance in flowable form (e.g., as a sherry) from a not illustrated source via a pump (not shown, because known per se). As the bag fills with the substance, the heretofore limp bag fills out and accommodates itself to the contours of the casing (e.g., 201) until it is plump and fully filled. The filling spout 206 is not twisted several times (FIG. 6) to block it against return flow of substance, and the hose then disconnected. Thereafter, a clamp 209 (e.g., a conventional hose clamp of requisite size) is placed about the spout 206 after the same is folded back upon itself (FIG. 7) and the arrangement is then left for the substance to harden and form a roof-supporting column. Once this has occurred, the casing (e.g., 201) may either be left in place or, for greater economy, it may be removed after e.g., detaching the clamps and can then be re-used. The bag 203 remains in place, although it of course has no further function once the substance has hardened.

Figure 8:
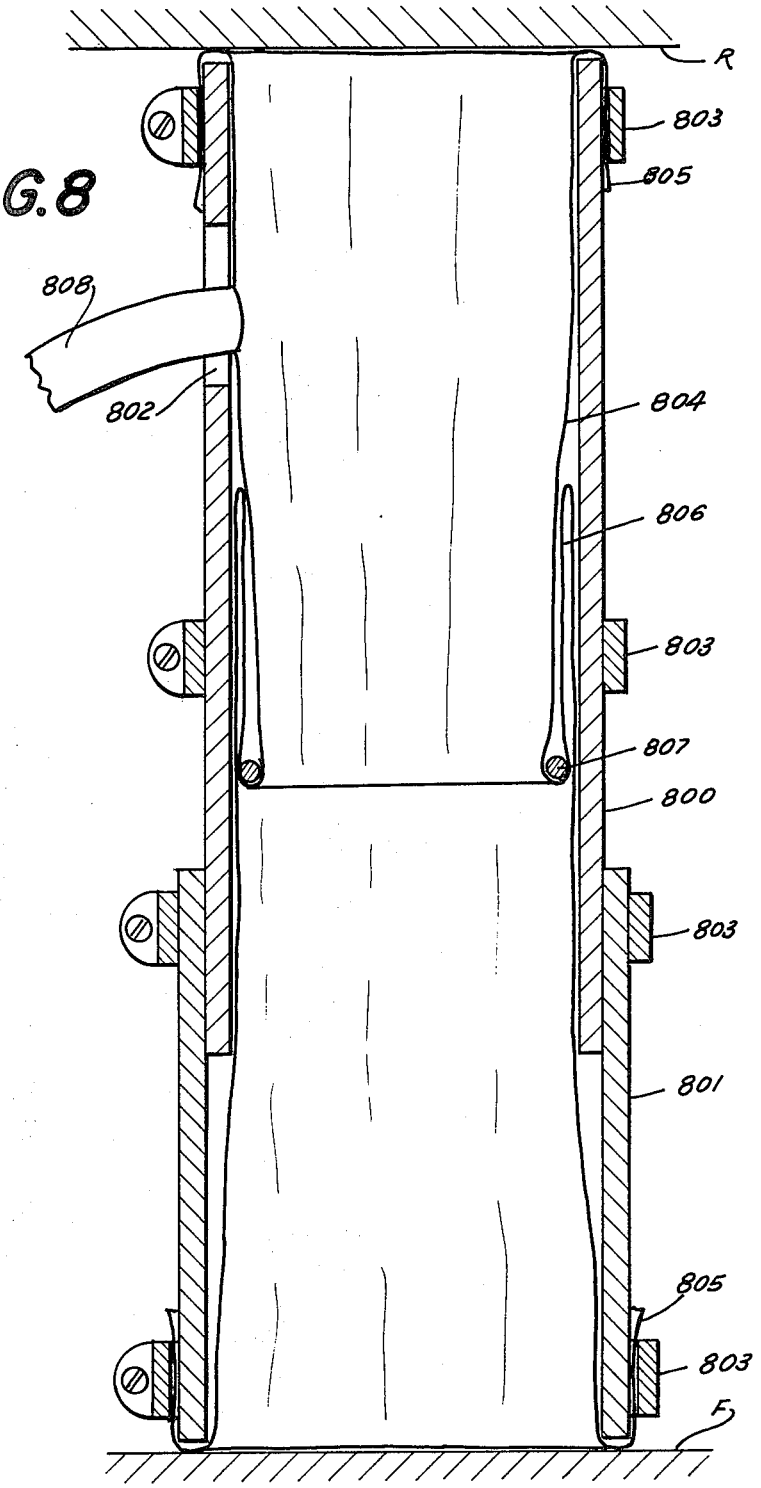
FIG. 8 is a vertical section through another embodiment of the invention.

In the embodiment of FIG. 8 an upper prop casing section 800 is telescoped into a lower section 801. The upper section has a hole 802 for the filling spout 808 of the bag 804. The sections 800, 801 are held at their desired degree of circumferential overlap and axial overlap, as well as reinforced, by clamps 803 similar to the clamps 103 of FIG. 1. The upper and lower end portions 805 of the bag 804 are folded out and over the sections 800, 801 to which they are secured by two of the clamps 803. The sections are telescoped apart to bear against the roof and floor which here, as in all other Figures in which they are shown, are designated with reference characters R and R, respectively.

As a rule, one bag length will be suitable for most applications. Of course, this means that the bag must be long enough to allow for the maximum expected distance between roof R and floor F. If the distance is smaller than this maximum, as in FIG. 8, the excess bag length is taken up inside the sections 800, 801 as a fold 806. However, if the fold is simply allowed to form as a function of telescoping-apart (or together) of the sections 800, 801 (there could evidently be more than two of these sections), it is probable that such uncontrolled fold formation would obstruct the later flow of hardenable substance and would, in the finished column, be the result of a local diameter-reduction of the column with the expectable drawbacks. Therefore, a circumferentially interrupted spring-steel ring 807 (somewhat analogous to a circlip) is inserted into the fold, to press the bag material outwardly and hold it in contact with the inner side of the respective section 800 and/or 801.

Figure 9:
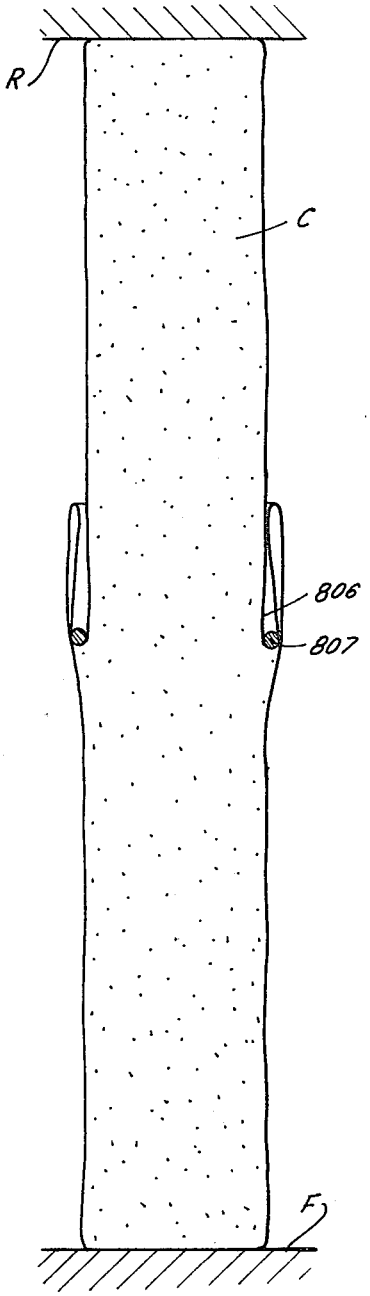
FIG. 9 is an elevation, partly in section, showing a column prepared with the embodiment of FIG. 8 in one adjusted position.
Figure 10:
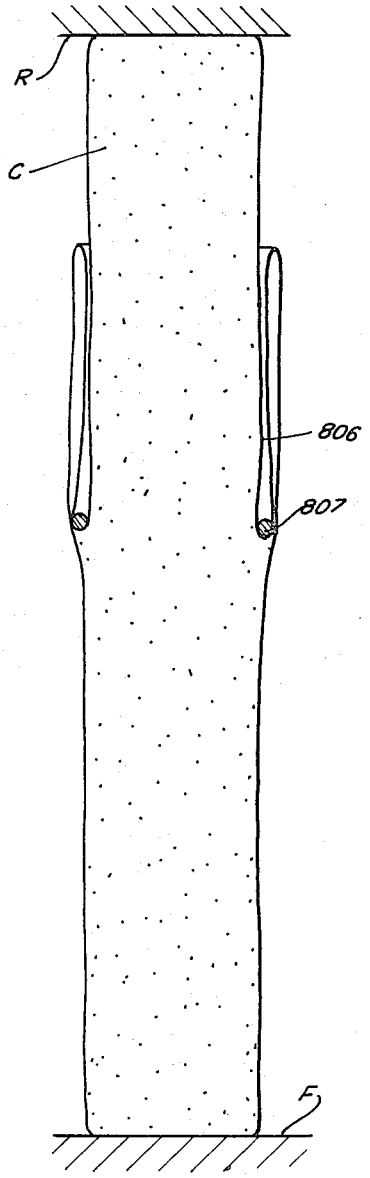
FIG. 10 is a view similar to FIG. 9, but showing a column prepared with the embodiment of FIG. 8 in a different adjusted position.

FIG. 9 shows the column C installed where the roof R is high, so that the bag has been pulled axially and the fold 806 is relatively small. By contrast, FIG. 10 shows an installation where the distance between floor F and roof R is smaller so that the bag did not require to have as much axial length as in FIG. 9, with the consequence that the fold 806 is larger.

Figure 11:
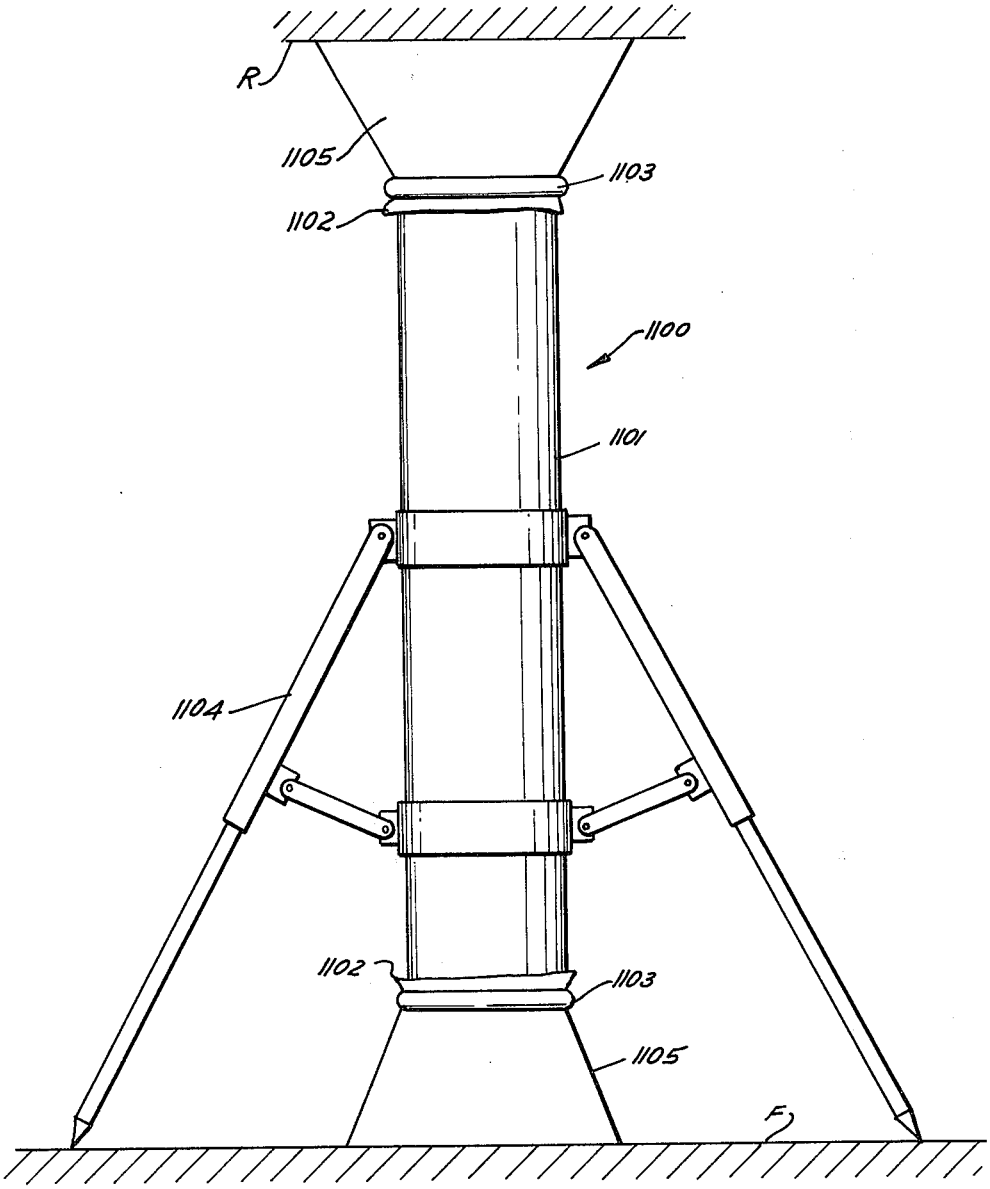
FIG. 11 is a side view of a further embodiment of the invention.

It is not (or may not be) always possible or necessary for the prop casing to bear upon the roof and floor, and circumstances may arise where the casing may be out of contact with the floor and/or the roof. Such a possibility is shown in FIG. 11 where, in the arrangement 1100, the casing 1101 is suspended between floor F and roof R by a supporting structure 1104 which may, as shown, have telescopable legs. This structure is shown by way of example only, since various other structures are also suitable.

The end portions 1102 of the bag in the casing 1101 are folded over onto the outside of the casing and held there by clamps 1103. The bag ends are closed so that none of the pumped-in flowable substance can escape. During or after hardening of the column of hardenable substance—whose upper and lower ends are spaced from the roof R and the floor F, respectively—connecting parts 1105 of e.g., quick-setting cement may be produced (by spraying or the like) at the upper and lower ends to connect the column to the roof and floor, respectively. Of course, the material for these parts 1105 must be sufficiently viscous to prevent its dripping or flowing off once it is applied and before it hardens. However, prefabricated parts 1105 might also be used. The conically divergent shape of parts 1105 is chosen to increase the size of the surface area over which stresses are transmitted to the column. Once the parts 1105 are in place (and hardened, if necessary), the support 1104 and the prop casing 1101 with its clamps 1103 can be removed, leaving the column (as shown in FIG. 12).

Figure 12:
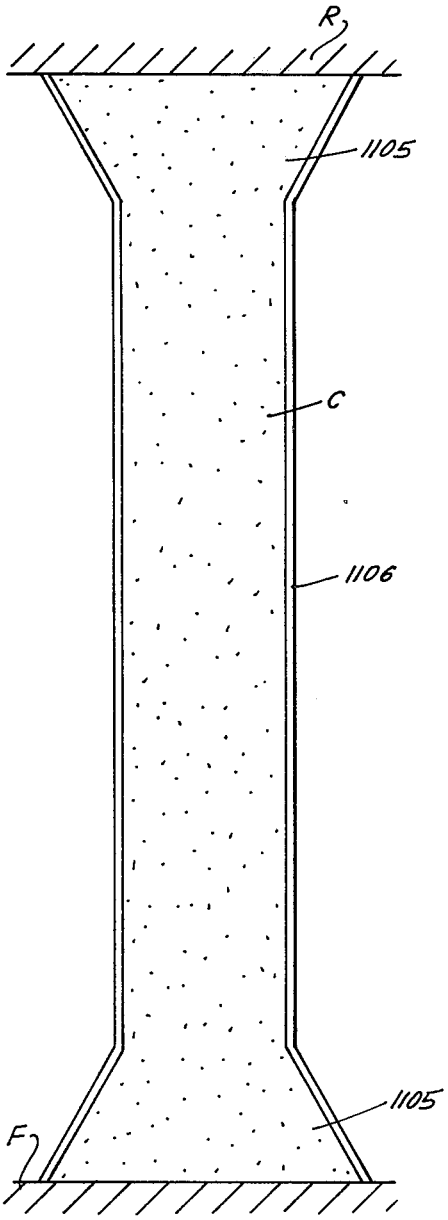
FIG. 12 is a vertical section through the embodiment in FIG. 11, with parts omitted.
Figure 13:
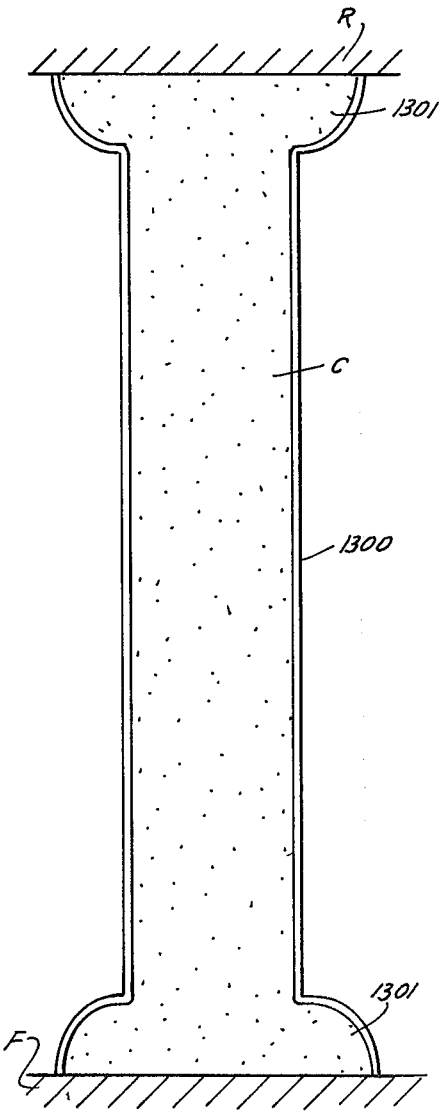
FIG. 13 is a view similar to FIG. 12, but illustrating a different column shape.

For explanation, FIG. 13 shows a column which is identical to the one in FIG. 12, except that the end parts 1301 formed outside the confines of bag 1300 are curved rather than frustoconical. Their purpose, however, is the same as in FIG. 12. Other shapes for the parts 1301 will also be suitable.

Figure 14:
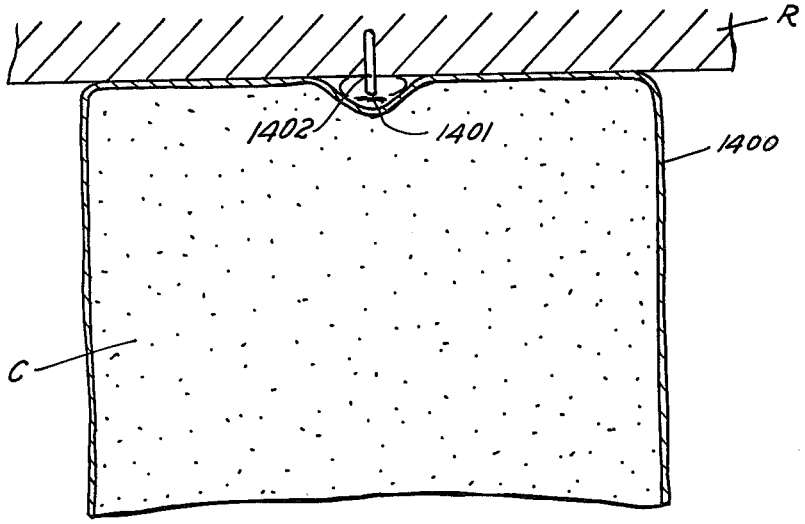
FIG. 14 is a fragmentary vertical section, showing the upper end of a column produced according to yet another embodiment of the invention.

FIG. 14 shows an embodiment in which the column of hardenable material is formed in a bag 1400 provided at its upper end with a loop 1401 by means of which it is suspended from a hook 1402 installed in the roof. The prop casing (not shown) is then simply erected about the bag 1400 and maintained in position until the material admitted into the bag has hardened to form the column C; thereafter it can be removed.

Figure 15:
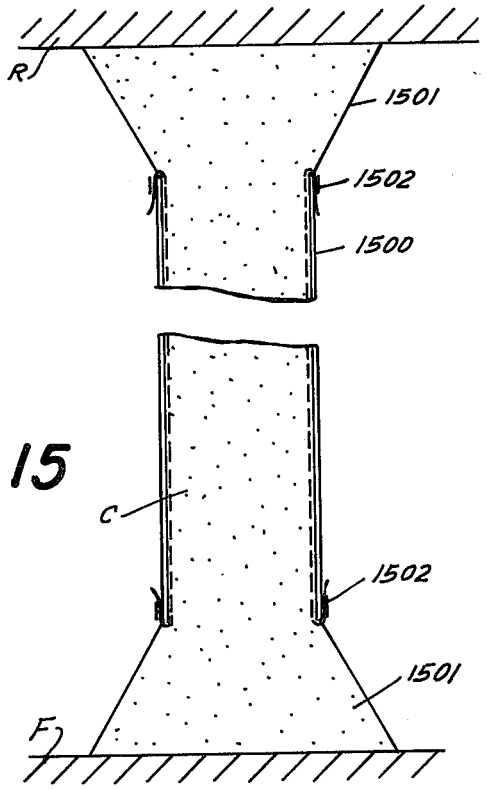
FIG. 15 is a diagrammatic vertical section of a further embodiment.

Finally, FIG. 15 shows that it is also possible to use a prop casing 1500 corresponding to one of the preceding ones and to secure not to its interior, but to its ends two bag lengths 1501 which are held in place by hose clamps 1502 or the like. Their free ends are then suitably secured to the floor F and roof R and the casing 1500 and bag sections 1501 filled with the hardenable substance which sets to form the column C. This embodiment is suited primarily for applications where there is a relatively small spacing between roof and floor.

It will be evident that in accordance with the disclosed method and system the supporting function which determines the final shape for the column C, is assigned to the prop casing whereas the containing function for the slurry is assigned to the bag. Moreover, it will also be understood that the invention readily permits accommodation to very substantial fluctuations in the distance between the roof R and the floor F and assures absolutely reliable retention of the flowable material even under widely varying roof and floor conditions. Since the bags are air permeable, relatively rapid hardening of the filled-in material can occur, which is important for economical operation.

The end parts 1105 and 1305 can, of course, also be produced by using appropriately shaped prop casing sections which are connected to the upper and lower ends of the cylindrical prop casing. This permits small fluctuations in the height of the excavation to be compensated by the use of such sections without thereby reducing the nominal cross-section of the column C.

While the invention has been illustrated and described as embodied in a mine support application, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of supporting an overburden, particularly a roof of an underground excavation such as a mine, comprising the steps of providing a hollow tubular prop casing having at least one section of self-supporting sheet material and which is circumferentially incomplete and has a longitudinally extending slit; overlapping marginal portions of said sheet material which bound said slit, to an extent requisite for obtaining a desired diameter of said section; arresting the overlapped portions in their overlapped condition; erecting the prop casing; installing in the prop casing a fabric bag extending lengthwise of the casing; and filling the fabric bag with a hardenable substance in flowable condition so that under the influence of the entering substance and shaped by the casing, the bag and its contents form a column which, upon hardening of the substance, is by itself able to support the roof.

2. A method as defined in claim 1, wherein the step of installing is carried out prior to the step of erecting.

3. A method as defined in claim 1; and further comprising the step of adjusting the length of the casing and of the bag in dependence upon the distance of the roof from a floor beneath the roof.

4. A method as defined in claim 1, wherein the step of filling comprises admitting the hardenable substance into the bag through a filling-spout hose; and further comprising twisting the filling-spout hose subsequent to such filling to prevent backflow of the substance, and securing the filling-spout hose in the twisted condition thereof.

5. A method as defined in claim 1, wherein the bag is longer than the casing and the step of installing includes forming a fold in the bag within the casing.

6. A method as defined in claim 1; and further comprising the step of suspending the casing in erected condition but out of contact with the roof and with a floor underneath the roof, until the hardenable substance has hardened.

7. A method as defined in claim 1, wherein the step of installing comprises suspending the bag from the roof so that the bag depends within the casing.

8. A roof supporting arrangement, particularly for supporting a roof of an underground excavation such as a mine, comprising a hollow tubular prop casing having at least one section of self-supporting sheet material and which is circumferentially incomplete and has a longitudinally extending slit bounded by marginal portions which can be overlapped to a desired degree to give said section a selectable diameter; means for arresting the marginal portions in a desired overlapped position; fabric bag means insertable into the section; and means for filling the fabric bag means with a hardenable substance in flowable condition so that the fabric bag means accommodates itself to the casing and the substance, upon hardening thereof, forms in the fabric bag means a solid column which is by itself able to support said roof.

9. An arrangement as defined in claim 8, wherein said arresting means comprises split-ring clamps surrounding said section at the exterior thereof.

10. An arrangement as defined in claim 8, wherein sais section has a hole; and further comprising filling-spout hose means on said bag means for filling the same with the hardenable substance, said hose means extending out through said hole.

11. An arrangement as defined in claim 10; and further comprising means closing said filling-spout hose means to prevent backflow of said substance.

12. An arrangement as defined in claim 8, said casing having upper and lower ends and said bag means being closed at top and bottom and having upper and lower end portions folded outside said upper and lower ends, said arresting means comprising clamps which surround said upper and lower ends and clamp said end portions in place.

13. An arrangement as defined in claim 8, wherein said bag means has a length greater than said casing and forms a fold within the casing; and further comprising a spring ring located in said fold and urging portions of said bag means into contact with an inner surface of said casing.

14. An arrangement as defined in claim 8; and further comprising means for suspending the casing intermediate and out of contact with the roof and with a floor beneath the same.

15. An arrangement as defined in claim 14; and further comprising means for securing sections of said bag means to opposite ends of said casing to extend therefrom to the roof and the floor, respectively.

16. An arrangement as defined in claim 8; and further comprising means for suspending said bag means from the roof so as to depend within said casing.

* * * * *